US005288431A

United States Patent [19]

Huber et al.

[11] Patent Number: 5,288,431

[45] Date of Patent: Feb. 22, 1994

[54] LIQUID LAUNDRY DETERGENT COMPOSITIONS WITH SILICONE ANTIFOAM AGENT

[75] Inventors: Alan C. Huber, Hamilton; Rajan K. Panandiker, West Chester, both of Ohio

[73] Assignee: The Procter & Gamble Company, Cincinnati, Ohio

[21] Appl. No.: 74,061

[22] Filed: Jun. 9, 1993

Related U.S. Application Data

[63] Continuation-in-part of Ser. No. 898,851, Jun. 15, 1992, abandoned.

[51] Int. Cl.[5] ..... C11D 1/82; C11D 1/66; C11D 3/32; C11D 3/37

[52] U.S. Cl. ..... 252/548; 252/174.15; 252/174.21; 252/174.23; 252/DIG. 14

[58] Field of Search ..... 252/548, 174.15, 174.21, 252/174.23

[56] References Cited

U.S. PATENT DOCUMENTS

| | | | |
|---|---|---|---|
| 2,703,798 | 3/1955 | Schwartz | 260/211 |
| 2,954,347 | 9/1960 | St. John et al. | 252/109 |
| 2,965,576 | 12/1960 | Wilson | 252/137 |
| 3,285,856 | 11/1966 | Lew | 252/152 |
| 3,351,557 | 11/1967 | Almstead | 252/106 |
| 3,455,839 | 7/1969 | Rauner | 252/321 |
| 3,576,749 | 4/1971 | Megson et al. | 252/132 |
| 3,654,166 | 4/1972 | Eckert et al. | 252/117 |
| 3,704,228 | 11/1972 | Eckert et al. | 252/117 |
| 3,920,586 | 11/1975 | Bonaparte et al. | 252/531 |
| 3,985,669 | 10/1976 | Krummel et al. | 252/116 |
| 4,098,818 | 7/1978 | Krummel et al. | 260/535 |
| 4,166,048 | 8/1979 | Nishimura et al. | 252/546 |
| 4,265,779 | 5/1981 | Gandolfo et al. | 252/135 |
| 4,483,780 | 11/1984 | Llenado | 252/135 |
| 4,492,646 | 1/1985 | Welch | 252/528 |
| 4,639,489 | 1/1987 | Aizawa et al. | 524/588 |
| 4,671,894 | 6/1987 | Lamb et al. | 252/545 |
| 4,749,740 | 6/1988 | Aizawa et al. | 524/588 |
| 4,978,471 | 12/1990 | Starch | 252/174.15 |
| 4,983,316 | 1/1991 | Starch | 252/174.15 |
| 5,009,814 | 4/1991 | Kelkenberg et al. | 252/548 |
| 5,154,849 | 10/1992 | Visscher et al. | 252/174.15 |

FOREIGN PATENT DOCUMENTS

| | | |
|---|---|---|
| 1580491 | 5/1969 | France . |
| 809060 | 2/1959 | United Kingdom . |
| WO-92-06154 | 4/1992 | World Int. Prop. O. . |

OTHER PUBLICATIONS

"Detergents Based on Sugars", Heike Kelkenberg, Tenside Surfactants Detergents 25, #2 (1988) *no month available.

*Primary Examiner*—Paul Lieberman
*Assistant Examiner*—Erin M. Higgins
*Attorney, Agent, or Firm*—Ken K. Patel; Ronald L. Hemingway; Jacobus C. Rasser

[57] ABSTRACT

This invention relates to homogeneous liquid laundry detergent compositions containing polyhydroxy fatty acid amide, silicone antifoam composition, and anionic, nonionic or amphoteric surfactant. The silicone antifoam composition includes polyethylene glycol or a copolymer of polyethylene-polypropylene glycol having a solubility in water at room temperature of more than about 2 weight %.

12 Claims, No Drawings

LIQUID LAUNDRY DETERGENT COMPOSITIONS WITH SILICONE ANTIFOAM AGENT

CROSS REFERENCE TO RELATED APPLICATION

This application is a Continuation-in-Part of application Ser. No. 898,851, filed Jun. 15, 1992, now abandoned entitled "Liquid Laundry Detergent Compositions with Silicone Antifoam Agent".

TECHNICAL FIELD

This relates to liquid laundry detergent compositions containing polyhydroxy fatty acid amide, silicone antifoam composition, and anionic, nonionic or amphoteric surfactant. The silicone antifoam composition includes primary antifoam agents, nonionic silicone surfactant, and polyethylene glycol or a copolymer of polyethylene-polypropylene glycol having a solubility in water at room temperature of more than about 2 weight %.

BACKGROUND OF THE INVENTION

Silicone antifoam compositions, and methods for producing them, have been described in, for example, U.S. Pat. Nos. 4,639,489 and 4,749,740, Aizawa et al, issued Jan. 27, 1987 and Jun. 7, 1988, respectively; and U.S. Pat. Nos. 4,978,471 and 4,983,316, Starch, issued Dec. 18, 1990 and Jan. 8, 1991, respectively.

Liquid laundry detergent compositions containing polyhydroxy fatty acid amide have been described in, for example, WO-92-06154, published Apr. 16, 1992. Anionic, nonionic and amphoteric surfactants are known ingredients of liquid laundry detergent compositions.

It has been found that it is difficult to formulate available silicone antifoam compositions into liquid laundry detergent compositions containing polyhydroxy fatty acid amide. These formulations tend to separate out after a few days in product. Even if they can be formulated into a storage stable product, they must also be effective at controlling suds in liquid laundry detergents. High suds are not desirable in the washing machine.

It has now been found that when polyethylene glycol (PEG), and/or copolymers of polyethylene-polypropylene glycol (PEG/PPG), having a solubility in water at room temperature of more than about 2 weight %, are substituted for the polypropylene glycol (PPG) heretofore present in a silicone antifoam composition, a stable, low sudsing liquid laundry detergent can be formulated. The liquid laundry detergent compositions, which contain polyhydroxy fatty acid amide, remain homogeneous upon storage. The silicone antifoam compositions with PEG and/or PEG/PPG copolymer are surprisingly better at suds reduction in this formulation in the washing machine than are the silicone antifoam compositions with PPG.

SUMMARY OF THE INVENTION

This relates to a homogenous liquid laundry detergent, comprising:

a. from about 1 to about 30 weight % of polyhydroxy fatty acid amide having the formula

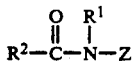

wherein $R^1$ is H, $C_1$ to $C_4$ hydrocarbyl, 2-hydroxy ethyl, 2-hydroxy propyl, or a mixture thereof, $R^2$ is a $C_5$ to $C_{31}$ hydrocarbyl, and Z is a polyhydroxyhydrocarbyl having a linear hydrocarbyl chain with at least 3 hydroxyls directly connected thereto, or an alkoxylated derivative thereof;

b. from about 0.001 to about 1 weight % of silicone antifoam composition comprising by weight % of said antifoam composition: (1) from about 5% to about 50% of a polyorganosiloxane and a resinous siloxane or a silicone resin-producing silicone compound; (2) from about 0.1% to about 15% of a finely divided filler material, (3) from about 0.01% to about 5% of a catalyst to promote formation of silanolates; (4) from about 1% to about 40% of at least one nonionic silicone surfactant; and (5) from about 10% to about 80% of a polyethylene glycol or a copolymer of polyethylene-polypropylene glycol having a solubility in water at room temperature of more than about 2 weight %; and without polypropylene glycol; and c. from about 1 to about 50 weight % of anionic or amphoteric or additional nonionic surfactant.

DETAILED DESCRIPTION OF THE INVENTION

Liquid laundry detergent compositions are provided herein which contain polyhydroxy fatty acid amide, silicone antifoam composition, and anionic, nonionic or amphoteric surfactant. These are described below.

A. Silicone Antifoam Composition

Silicones are well known antifoam agents, or suds suppressors. In the antifoam composition of the present invention, the solvent for a continuous phase is made up of certain polyethylene glycols or polyethylene-polypropylene glycol copolymers or mixtures thereof (preferred), and not polypropylene glycol. The primary antifoam agent herein is branched/cross-linked and not linear.

The liquid laundry detergent compositions herein comprise from about 0.001 to about 1, preferably from about 0.01 to about 0.7, most preferably from about 0.05 to about 0.5, weight % of silicone antifoam composition. The silicone antifoam composition comprises by weight % of the antifoam composition: (1) from about 5% to about 50%, preferably from about 20% to about 40%, of a polyorganosiloxane and a resinous siloxane or a silicone resin-producing silicone compound; (2) from about 0.1% to about 15%, preferably from about 5% to about 10%, of a finely divided filler material, (3) from about 0.01% to about 5%, preferably from about 1% to about 3%, of a catalyst to promote formation of silanoloates; (4) from about 1% to about 40%, preferably from about 10% to about 30%, of at least one nonionic silicone surfactant; and (5) from about 10% to about 80%, preferably from about 30% to about 60%, of a polyethylene glycol or a copolymer of polyethylene-polypropylene glycol having a solubility in water at room temperature of more than about 2 weight %; and without polypropylene glycol.

The primary antifoam agents and the nonionic silicone surfactant are as described in U.S. Pat. No. 4,978,471, Starch, issued Dec. 18, 1990, and 4,983,316, Starch, issued Jan. 8, 1991, which are incorporated herein by reference.

Secondary antifoam agents can also be included although they are not preferred. The preferred secondary antifoam agents herein is polydimethyl siloxane with a viscosity of about 1,000 centistokes. Stabilizing agents and preservatives as described by Starch can also be included in the silicone antifoam compositions herein.

Silicone antifoam compositions herein are dispersible, or easily distributed in the liquid detergent composition such that suds are controlled and the composition is homogeneous.

The most preferred primary antifoam agent is as described in U.S. Pat. Nos. 4,639,489 and 4,749,740, Aizawa et al , which are incorporated herein by reference. The preferred silicone antifoam composition is as described therein in column 1, line 46 through column 4, line 35.

In order to render the primary (and secondary) antifoam agents dispersible in aqueous medium, such as a liquid laundry detergent, there is included along with the antifoam agent, at least one nonionic silicone surfactant for emulsifying the antifoam agent in a solvent. An appropriate nonionic silicone surfactant is a copolymer of resinous siloxane and polyalkylene oxide.

The polyethylene glycol and polyethylene/polypropylene copolymers herein have a solubility in water at room temperature of more than about 2 weight %, preferably more than about 5 weight %.

The silicone antifoam composition herein preferably comprises polyethylene glycol and a copolymer of polyethylene glycol/polypropylene glycol, all having an average molecular weight of less than about 1,000, preferably between about 100 and 800.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The silicone antifoam compositions herein do not contain polypropylene glycol, particularly of 4,000 molecular weight, previously used as a solvent. They preferably do not contain block copolymers of ethylene oxide and propylene oxide, like Pluronic ®L101.

The primary (and secondary) antifoam agents are preferably mixed and emulsified in the polyethylene glycol and/or the copolymers of polyethylene glycol/polypropylene glycol with solubility in water greater than 2% by weight, along with the nonionic silicone surfactant. This is then added to the liquid laundry detergent.

B. Polyhydroxy Fatty Acid Amide

The liquid laundry detergent compositions herein comprise from about 1 to about 30, preferably from about 2 to about 15, weight % of polyhydroxy fatty acid amide.

Polyhydroxy fatty acid amide surfactant comprises compounds of the structural formula:

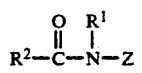

(I)

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

The polyhydroxy fatty acid amide preferred herein is glucose amide, preferably $C_{12-18}$ N-acetyl glucamide.

C. Surfactant

The liquid laundry detergent compositions herein comprise from about 1 to about 50, preferably from about 10 to about 30, weight % of anionic or amphoteric or additional nonionic surfactant.

These are preferably selected from the group consisting of $C_{9-20}$ linear alkylbenzene sulfonate, $C_{12-20}$ alkyl sulfate, $C_{12-20}$ alkyl ether sulfate, $C_{8-18}$ alkenyl carboxysulfonate, $E_{2-20}$ ethoxylated $C_{10-20}$ alcohols, and mixtures thereof. More preferred are $E_{2-20}$ ethoxylated $C_{10-20}$ alcohols, particularly $E_{2-5}$ ethoxylated $C_{12-18}$ alcohols.

Amphoteric surfactants are described in, for example, *Amphoteric Surfactants,* BR Bluestein & CL Hilton, Marcel Dekker, Inc., NY (1982). Preferred are imidazoline derivatives and betaines.

1. Anionic Surfactant

Anionic surfactants useful for detersive purposes are included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British Patent Specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH$-

$_2COO^-M^+$ wherein R is a $C_8$–$C_{22}$ alkyl, k is an integer from 0 to 10, and M is a soluble salt-forming cation, and fatty acids esterified with isothionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

One type of anionic surfactant preferred for liquid detergent compositions herein is alkyl ester sulfonates. These are desirable because they can be made with renewable, non-petroleum resources. Preparation of the alkyl ester sulfonate surfactant component is according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

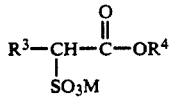

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperydinium, and cations derived from alkanolamines, e.g. monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12\text{-}16}$ are preferred for lower wash temperatures (e.g., below about 50° C.) and $C_{16\text{-}18}$ alkyl chains are preferred for higher wash temperatures (e.g., above about 50° C.).

Alkyl alkoxylated sulfate surfactants are another category of useful anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperydinium and cations derived from alkanolamines, e.g. monoethanolamine, diethanolamine, and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium.

2. Nonionic Surfactant

Preferably the nonionic surfactant is the condensation product of $C_{10}$–$C_{20}$ alcohol and between about 2 and about 20 moles of ethylene oxide per mole of alcohol ("$E_{2\text{-}20}$ ethoxylated $C_{10\text{-}20}$ alcohol"). This is in addition to the polyhydroxy fatty acid amide.

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. These compounds are commonly referred to as alkyl phenol alkoxylates, (e.g., alkyl phenol ethoxylates).

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. This category of nonionic surfactant is referred to generally as "alkyl ethoxylates."

3. The condensation products of ethylene oxide with a hydrophobic base formed by the condensation of propylene oxide with propylene glycol.

4. The condensation products of ethylene oxide with the product resulting from the reaction of propylene oxide and ethylenediamine.

5. Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units.

D. Other Ingredients

Other ingredients suitable for use in liquid laundry detergents are preferably included herein. They include detergency builders, pH neutralizing agents, buffering agents, hydrotropes, enzymes, enzyme stabilizing agents, soil release polymers, dyes, brighteners, perfumes, and bactericides. These are described in U.S. Pat. No. 4,285,841, Barrat et al, issued Aug. 25, 1981, incorporated herein by reference.

Suitable enzymes, smectite-type clays, detergency builders, solvents, hydrotropes, and antistatic agents are described in U.S. Pat. No. 4,844,824, Mermelstein et al, issued Jul. 4, 1989, incorporated herein by reference. Inorganic detergency builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. Borate builders, as well as builders containing borate-forming materials that can produce borate under detergent storage or wash conditions (hereinafter, collectively "borate builders"), can also be used.

Suitable polymeric dispersing agents are described in, for example, U.S. Pat. No. 3,308,067, Diehl, issued Mar. 7, 1967, incorporated herein by reference.

Useful soil release agents for use herein are described in U.S. Pat. Nos. 4,000,093, Nicol et al, issued Dec. 28, 1976, 3,959,230, Hays, issued May 25, 1976, 4,702,857, Gosselink, issued Oct. 27, 1987, and 4,721,580, Gosselink, issued Jan. 26, 1988, all incorporated herein by reference. Soil release and antiredeposition agents are described in U.S. Pat. No. 4,597,898, VanderMeer, issued Jul. 1, 1986, and U.S. Pat. No. 4,548,744, Connor, issued Oct. 22, 1985, both incorporated herein by reference.

Suitable chelating agents are described in, for example, U.S. Pat. No. 4,909,953, Sadlowski et al, issued Mar. 20, 1990, incorporated herein by reference.

Alkenyl carboxysulfonates (ACS), which can be included herein, are multifunctional developmental detergent additives. They contain two anionic functions, sulfonate and carboxylate, as well as an ester or an amide. They are made from the reaction of alkenylsuccinic anhydrides with either sodium isothionate or sodium N-methyltaurine. The structural formula for ACS is:

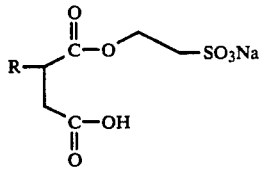

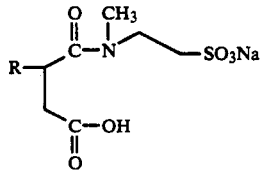

where the alkenyl group in the ACS is in the range of $C_8$ to $C_{18}$.

The liquid detergent compositions herein preferably have a pH in a 10% solution in water at 20° C. of between about 6.5 and 11.0, preferably between about 7.0 and 8.5. Techniques for controlling pH include the uuse of buffers, alkalis, acids, etc., and are well known to those skilled in the art.

Preferred are heavy duty liquid laundry detergent compositions with a wash water pH during aqueous cleaning operations of between about 6.5 and 10.0.

Preferred herein are concentrated liquid laundry detergent compositions. Typical regular dosage of heavy duty liquids is 118 milliliters in the U.S. (½ cup) and 180 milliliters in Europe. Concentrated liquid detergent compositions contain about 10 to 100 weight % more active detersive ingredients than regular compositions, and are dosed at less than ½ cup, depending on their active levels (e.g. ¼–⅓ cup). Preferred are liquid laundry detergents with from about 30 to about 90, preferably from about 40 to about 80, weight % of active detersive ingredients. The detergent is added to the washing machine and the laundry, detergent and water are agitated.

This invention further provides a method for preparing a homogeneous liquid laundry detergent composition containing polyhydroxy fatty acid amide and silicone antifoam composition, comprising selecting a silicone antifoam composition which comprises polyethylene glycol or a random copolymer of polyethylenepolypropylene glycol having a solubility in water at room temperature of more than about 2 weight %, but not polypropylene glycol.

The following examples illustrate the compositions of the present invention, but are not necessarily meant to limit or otherwise define the scope of the invention.

All parts, percentages and ratios used herein are by weight unless otherwise specified.

EXAMPLE 1

A concentrated built heavy duty liquid with the following composition is prepared:

| Component | Wt. % |
|---|---|
| C14–15 alkyl polyethoxylate (2.25) sulfonic acid | 23.00 |
| Diethylenetriaminepenta(methylene phosphonic acid) | 0.95 |
| 1,2 Propanediol | 12.50 |
| Monoethanolamine | 12.50 |
| C12–13 alkyl polyethoxylate (6.5) | 2.00 |
| Ethanol | 3.80 |
| Polyhydroxy C12–14 fatty acid amide | 9.00 |

-continued

| Component | Wt. % |
|---|---|
| C12-14 coconut fatty acid | 9.00 |
| Citric acid | 6.00 |
| Boric acid | 2.40 |
| Tetraethylenepentaamine ethoxylate (15-18) | 1.00 |
| Brightener | 0.14 |
| Silicone antifoam composition A | 0.10 |
| Water/miscellaneous | Balance |
| | 100% |
| Silicone antifoam composition A | |
| Cross-linked primary silicone antifoam agent, with silica | 33.0 |
| Linear high molecular weight polydimethyl siloxane | 8.4 |
| Resinous siloxane co-polyols | 3.8 |
| Ethoxy-8-octyl phenol | 1.5 |
| Block polymer of ethylene oxide and propylene oxide (Pluronic ® L101) | 8.3 |
| Polypropylene glycol 4000 molecular weight | 45.0 |

EXAMPLE II

A concentrated built heavy duty liquid with the following composition is prepared:

| Component | Wt. % |
|---|---|
| $C_{14-15}$ alkyl polyethoxylate (2.25) sulfonic acid | 23.00 |
| Diethylenetriaminepenta(methylene phosphonic acid) | 0.95 |
| 1,2 Propanediol | 12.50 |
| Monoethanolamine | 12.50 |
| $C_{12-13}$ alkyl polyethoxylate (6.5) | 2.00 |
| Ethanol | 3.80 |
| Polyhydroxy $C_{12-14}$ fatty acid amide | 9.00 |
| $C_{12-14}$ coconut fatty acid | 9.00 |
| Citric acid | 6.00 |
| Boric acid | 2.40 |
| Tetraethylenepentaamine ethoxylate (15-18) | 1.00 |
| Brightener | 0.14 |
| Silicone antifoam composition B | 0.10 |
| Water/miscellaneous | Balance |
| | 100% |
| Silicone antifoam composition B | |
| Cross-linked primary silicone antifoam agent, with silica, and | 35.6 |
| Linear high molecular weight polydimethyl siloxane | |
| Resinous siloxane co-polyol | 10.0 |
| Polyethylene glycol 300 molecular weight | 8.0 |
| Copolymer of polyethylene glycol/polypropylene glycol | 42.0 |
| Quartz, ground | 11.0 |

The above heavy duty liquids are tested for suds control using standard test washing machine conditions (95° F., 0 hardness, clean ballast). The suds control properties are measured with a calibrated suds gauge in a U.S. specification washing machine. The results are as follows:

| Example | Inches of suds |
|---|---|
| I | 14.0 (35.5 cm) |
| II | 2.0 (5.1 cm) |

The heavy duty liquid with silicone antifoam composition B, which is within the present invention, has significantly fewer suds than the heavy duty liquid with silicone antifoam composition of Example I, which is outside the present invention.

EXAMPLE III

A concentrated built heavy duty liquid with the following composition is prepared:

| Component | Wt. % |
|---|---|
| $C_{14-15}$ alkyl polyethoxylate (2.25) sulfonic acid | 18.00 |
| Sodium cumene sulfonate | 2.00 |
| 1,2 Propanediol | 7.00 |
| Monoethanolamine | 2.03 |
| $C_{12-13}$ alkyl polyethoxylate (6.5) | 2.00 |
| Ethanol | 5.00 |
| Sodium hydroxide | 4.88 |
| Polyhydroxy $C_{12-14}$ fatty acid amide | 4.00 |
| $C_{12-14}$ coconut fatty acid | 2.00 |
| Citric acid | 6.00 |
| Sodium formate | 0.09 |
| Boric acid | 1.50 |
| Tetraethylenepentaamine ethoxylate (15-18) | 1.00 |
| Polymer | 0.30 |
| Protease | 0.0135 |
| Lipase | 0.12 |
| Brightener | 0.10 |
| Silicone antifoam composition B | 0.10 |
| Water/miscellaneous | Balance |
| | 100% |
| Silicone antifoam composition B | |
| Cross-linked primary silicone antifoam agent, with silica, and | 35.6 |
| Linear high molecular weight polydimethyl siloxane | |
| Resinous siloxane co-polyol | 10.0 |
| Polyethylene glycol 300 molecular weight | 8.0 |
| Copolymer of polyethylene glycol/polypropylene glycol | 42.0 |
| Quartz, ground | 11.0 |

The above heavy duty liquid is tested for suds control using the above standard, controlled conditions. The suds control properties are measured with a calibrated suds gauge in a U.S. specification washing machine. The product is tested for initial performance after heat aging at a constant temperature. The results are as follows:

| Example | Inches of suds |
|---|---|
| III | 2.7 (6.9 cm) |

The heavy duty liquid with silicone antifoam composition B, which is within the present invention, still exhibits low sudsing even after it is heat aged.

EXAMPLE IV

A concentrated built heavy duty liquid with the following composition is prepared:

| Component | Wt. % |
|---|---|
| $C_{14-15}$ alkyl polyethoxylate (2.25) sulfonic acid | 21.00 |
| 1,2 Propanediol | 7.00 |
| Monoethanolamine | 3.50 |
| Ethanol | 5.00 |
| Sodium hydroxide | 3.00 |
| Polyhydroxy $C_{12-14}$ fatty acid amide | 7.00 |
| $C_{12-14}$ coconut fatty acid | 3.00 |
| Citric acid | 6.00 |
| Boric acid | 2.00 |
| Tetraethylenepentaamine ethoxylate (15-18) | 1.50 |
| Brightener | 0.12 |
| Silicone antifoam composition B | 0.10 |
| Water/miscellaneous | Balance |
| | 100% |
| Silicone antifoam compositon B | |
| Cross-linked primary silicone suds suppressor, with silica, and | 35.6 |
| Linear high molecular weight polydimethyl siloxane | |
| Resinous siloxane co-polyol | 10.0 |
| Polyethylene glycol 300 molecular weight | 8.0 |
| Copolymer of polyethylene glycol/polypropylene | 42.0 |

-continued

| Component | Wt. % |
|---|---|
| glycol | |
| Quartz, ground | 11.0 |

EXAMPLE V

A concentrated built heavy duty liquid with the following composition is prepared:

| Component | Wt. % |
|---|---|
| C12.3 Linear alkyl sulfonic acid | 17.00 |
| 1,2 Propanediol | 7.00 |
| Monoethanolamine | 2.00 |
| $C_{12-13}$ alkyl polyethoxylate (6.5) | 6.00 |
| Ethanol | 5.00 |
| Sodium hydroxide | 4.00 |
| Polyhydroxy $C_{12-14}$ fatty acid amide | 9.00 |
| $C_{12-14}$ coconut fatty acid | 9.00 |
| Citric acid | 6.00 |
| Boric acid | 2.00 |
| Tetraethylenepentaamine ethoxylate (15-18) | 1.00 |
| Brightener | 0.15 |
| Silicone antifoam composition B | 0.10 |
| Water/miscellaneous | Balance |
| | 100% |
| Silicone antifoam compositon B | |
| Cross-linked primary silicone suds suppressor, with silica, and | 35.6 |
| Linear high molecular weight polydimethyl siloxane | |
| Resinous siloxane co-polyol | 10.0 |
| Polyethylene glycol 300 molecular weight | 8.0 |
| Copolymer of polyethylene glycol/polypropylene glycol | 42.0 |
| Quartz, ground | 11.0 |

What is claimed is:

1. A homogenous liquid laundry detergent composition, comprising:

a. from about 1 to about 30 weight % of polyhydroxy fatty acid amide having the formula

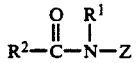

wherein $R^1$ is H, $C_1$ to $C_4$ hydrocarbyl, 2-hydroxy ethyl, 2-hydroxy propyl, or a mixture thereof, $R^2$ is a $C_5$ to $C_{31}$ hydrocarbyl, and Z is a polyhydroxyhydrocarbyl having a linear hydrocarbyl chain with at least 3 hydroxyls directly connected thereto, or an alkoxylated derivative thereof;

b. from about 0.001 to about 1 weight % of silicone antifoam composition comprising by weight % of said antifoam composition: (1) from about 5% to about 50% of a polyorganosiloxane and a resinous siloxane or a silicone resin-producing silicone compound; (2) from about 0.1% to about 15% of a finely divided filler material, (3) from about 0.01% to about 5% of a catalyst to promote formation of silanolates; (4) from about 1% to about 40% of at least one nonionic silicone surfactant; and (5) from about 10% to about 80% of a copolymer of polyethylenepolypropylene glycol having a solubility in water at room temperature of more than about 2 weight %; and without polypropylene glycol; and c. from about I to about 50 weight % of anionic or amphoteric or additional nonionic surfactant.

2. A homogeneous liquid laundry detergent composition according to claim 1 wherein the silicone antifoam composition comprises polyethylene glycol and a copolymer of polyethylene glycol/polypropylene glycol, all having an average molecular weight of less than about 1,000.

3. A homogeneous liquid laundry detergent composition according to claim 1 wherein the nonionic silicone surfactant is a copolymer of resinous siloxane and polyalkylene oxide.

4. A homogeneous liquid laundry detergent composition according to claim 2 comprising from about 0.01 to about 0.7 weight % of silicone antifoam composition.

5. A homogeneous liquid laundry detergent composition according to claim 4 comprising from about 2 to about 15 weight % of polyhydroxy fatty acid amide.

6. A homogeneous liquid laundry detergent composition according to claim 5 wherein the silicone antifoam composition comprises polyethylene glycol having an average molecular weight of between about 100 and 800, and a copolymer of polyethylene glycol/polypropylene glycol.

7. A homogeneous liquid laundry detergent composition according to claim 8 wherein the nonionic surfactant is the condensation product of $C_{10-20}$ alcohol and between about 2 and about 20 moles of ethylene oxide per mole of alcohol.

8. A homogeneous liquid laundry detergent composition according to claim 1 comprising a secondary antifoam agent.

9. A homogeneous liquid laundry detergent composition according to claim 4 wherein the solubility in water at room temperature of polyethylene glycol and copolymer of polyethylene glycol/polypropylene glycol is more than about 5 weight %.

10. A homogeneous liquid laundry detergent composition according to claim 9 wherein the silicone antifoam composition excludes block copolymers of ethylene oxide-propylene oxide.

11. A homogeneous liquid laundry detergent composition according to claim 10 wherein the weight ratio of polyethylene glycol:copolymer of polyethylene-polypropylene glycol is between about 1:1 and 1:10.

12. A homogeneous liquid laundry detergent composition according to claim 4 wherein the secondary antifoam agent is polydimethyl siloxane with a viscosity of about 1,000 centistokes.

* * * * *

UNITED STATES PATENT AND TRADEMARK OFFICE

CERTIFICATE OF CORRECTION

PATENT NO. : 5,288,431

DATED : Feb. 22, 1994

INVENTOR(S) : Alan C. Huber and Rajan K. Panandiker

It is certified that error appears in the above-identified patent and that said Letters Patent is hereby corrected as shown below:

In column 12, line 55, change "claim 4" to --claim 11--.

Signed and Sealed this

Eleventh Day of April, 1995

Bruce Lehman

*Attest:*

BRUCE LEHMAN

*Attesting Officer*

*Commissioner of Patents and Trademarks*